United States Patent [19]

Marino

[11] Patent Number: 4,711,363

[45] Date of Patent: Dec. 8, 1987

[54] TAMPER EVIDENCE CLOSURE

[75] Inventor: Michael Marino, New Castle, Pa.

[73] Assignee: West Penn Plastic, Inc., New Castle, Pa.

[21] Appl. No.: 44,786

[22] Filed: May 1, 1987

[51] Int. Cl.[4] ..... B65D 41/32

[52] U.S. Cl. ..... 220/266; 220/254; 220/339; 220/307; 215/237; 222/153

[58] Field of Search ..... 220/266, 270, 254, 307, 220/339; 222/153, 23, 556, 498, 545; 215/253, 209, 235, 237

[56] References Cited

U.S. PATENT DOCUMENTS

| | | | |
|---|---|---|---|
| 4,361,250 | 11/1982 | Foster | 220/266 |
| 4,463,869 | 8/1984 | Lewis | 220/307 |
| 4,519,517 | 5/1985 | Walter | 215/253 |
| 4,533,058 | 8/1985 | Uhlig | 215/237 |
| 4,538,731 | 9/1985 | Cillario | 220/339 |
| 4,592,480 | 6/1986 | Hart et al. | 220/270 |
| 4,595,123 | 6/1986 | Lilit | 222/153 |
| 4,621,744 | 11/1986 | Foster | 220/270 |

*Primary Examiner*—George T. Hall

*Attorney, Agent, or Firm*—Harpman & Harpman

[57] ABSTRACT

A tamper evidencing closure for use on containers containing food stuffs and the like comprises multiple cap configuration intrically joined to a closure by a live hinge. A secondary cap is formed within the first with frangible tamper evidence strips and a secondary live hinge. A tubular plug depends from the underside of said secondary cap and is registerable into a dispenser opening within the closure. Assembly pins secure the cap to the closure and a annular rib on the tubular plug forms a seal around the dispensing opening when the tubular plug is in closed position and holds the secondary cap and plug in closed position once the frangible tear strips are broken.

6 Claims, 5 Drawing Figures

TAMPER EVIDENCE CLOSURE

BACKGROUND OF THE INVENTION

1. Technical Field:

This invention relates to closures for containers having tamper evident configurations on them which have a dispensing opening therethrough for dispensing products from the containers.

2. Description of Prior Art:

Prior Art devices of this type have relied on a variety of different tamper evident designs, see for example U.S. Pat. Nos. 4,595,123 and 4,592,480.

In U.S. Pat. No. 4,595,123 a tamper evident closure cap is disclosed having a sealing flange frame that is independently positioned over the closure with a hingeable cap within. A plurality of tabs on the sealing flange are registerable within the cap so that once the flange is removed evidence of tamper will be readily apparent.

In U.S. Pat. No. 4,592,480 a tamper evidencing container cap is shown having a variety of alternate forms of the invention in which the closure configuration secured to the container has secondary product dispensing caps within, with a number of different tamper evident release segments extending therefrom.

SUMMARY OF THE INVENTION

A tamper evidencing closure for a container containing food stuffs and the like includes configurations for securing the closure to a dispenser container and a intrical multi-cap configuration secured to the closure by a live hinge and nonremovable assembly pins. A tubular plug depends from the bottom of the multiple cap sealingly registerable within the dispenser container. A tamper evidencing frangible strip is used to secure a secondary cap to the multiple cap and once broken indicates evidence of tampering to the cap.

DESCRIPTION OF THE PREFERRED EMBODIMENT

Figure 4:
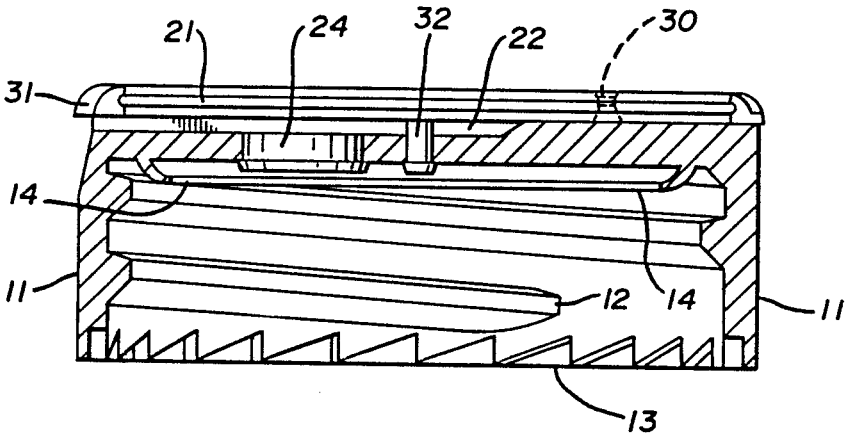
FIG. 4 is a sectional view in elevation of the dispensing closure of the invention in closed position.
Figure 5:
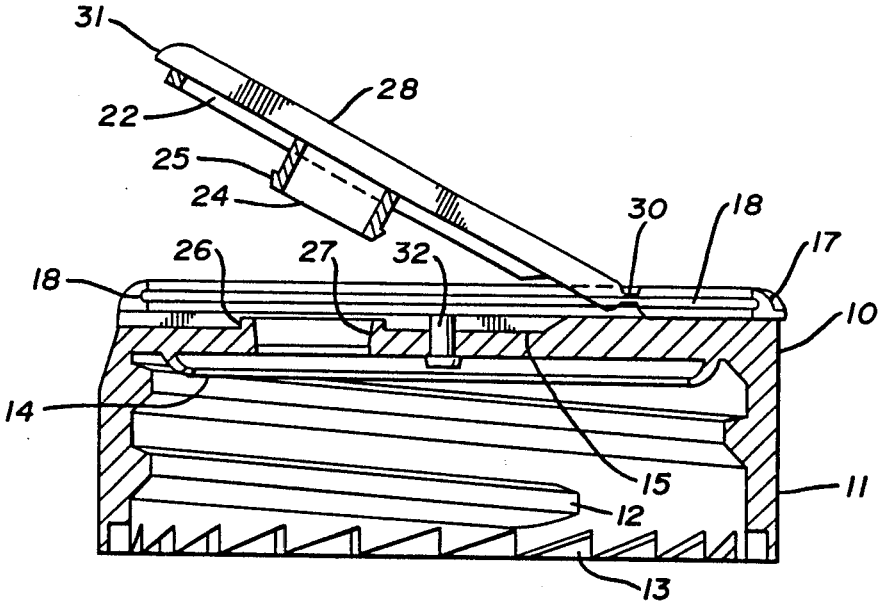
FIG. 5 is a sectional view in elevation of the dispenser closure of the invention in tamper evidence position indicating open.

A tamper evident enclosure with a multiple cap configuration may be seen in FIGS. 4 and 5 of the drawings in closed and tamper evident open positions respectively. By referring to FIG. 1 of the drawings, the tamper evident closure comprises a top portion 10 having a depending annular flange 11 with a continuous threaded pattern 12 within and a plurality of rachet recessed teeth 13 extending inwardly around the lower portion of the depending annular flange 11.

A registering rachet configuration is formed on a container (not shown) having a neck portion with a registering continuous thread pattern thereon to which the tamper evident closure is rotatably affixed by final engagement of the rachet recessed teeth 13 which provides evidence of attempted removal of the entire tamper evident closure from the container neck by distorting and damaging the closure if reversed rotation is imparted once the rachet recessed teeth 13 are engaged thereon.

The lower surfaces of the top portion 10 has an annular cross-sectionally curved sealing flange 14 arranged for sealing registration with the upper surface of the container on which the dispensing closure is positioned. A generally rectangular recessed portion 15 is formed in the top portion 10 extending inwardly from the perimeter of the top portion 10 to a point just past the mid-center of the top ending with a tapered portion 16 extending transversely on the top portion.

Figure 2:
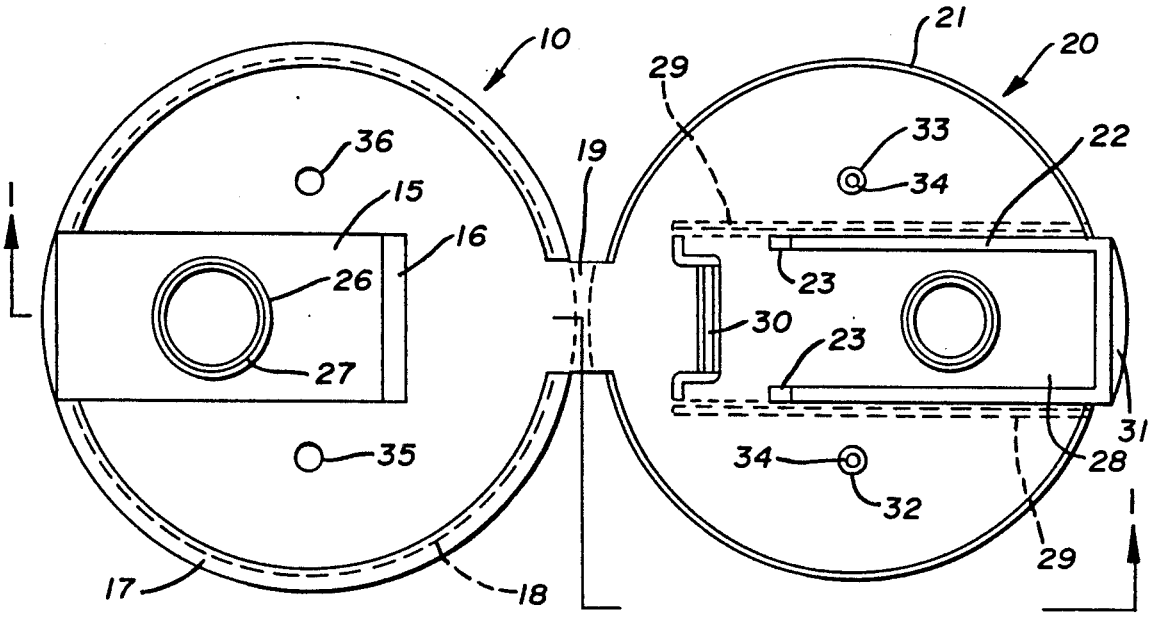
FIG. 2 is a plan view of the closure with the cap in open position relative to the closure.
Figure 1:
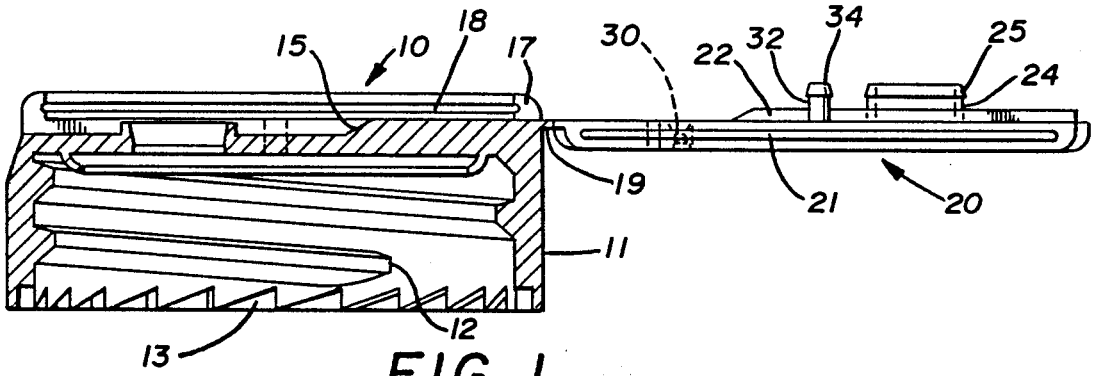
FIG. 1 is a sectional view on lines 1—1 of FIG. 2.

An annular flange 17 extends around the perimeter edge of the top portion 10 and has a groove 18 formed on its inner edge, best seen in FIGS. 1, 2, and 5 of the drawings. A live hinge 19 is formed on the opposite side of the top portion relative the recess portion 15 on the perimeter edge thereof. The hinge 19 is intrically formed with a multiple cap 20 which has an elongated annular bead 21 which is registerable within the groove 18 of the annular flange 17.

An elongated guide rib 22 extends from the surface of the multiple cap 20 having tapered free ends 23 and is aligned thereon to be registerable within the recessed portion 15 in the top portion 10 upon closing of the multiple cap, as seen in Figures 4 and 5 of the drawings. A tubular plug 24 depends from the multiple cap 20 within the area defined by the guide rib 22 and is of a length greater than that of the height of the surrounding guide rib 22. An annular rib 25 is formed on the exterior of the tubular plug 24 adjacent its free end and spaced with respect to the upper portion of the multiple cap 20 a distance enabling the annular rib 21 to engage the lower surface of the recessed portion 15 around an elevated dispensing opening 26 formed therein when the multiple cap 20 is in closed position as illustrated in FIGS. 4 and 5 of the drawings.

The dispensing opening 26 has a downwardly and inwardly tapered side wall 27 to facilitate the entry of the tubular plug 24 and its outer tapered end configuration.

Figure 3:
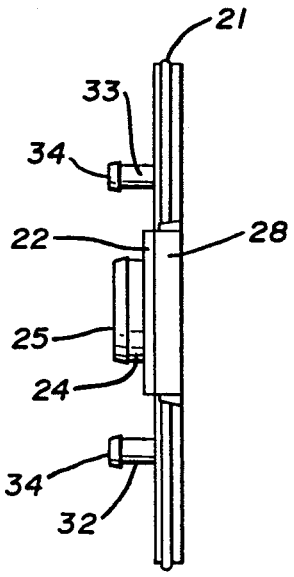
FIG. 3 is end plan view of the cap.

Referring now to FIGS. 2, 3, and 5 of the drawings a secondary cap 28 can be seen releaseably formed from a portion of the multiple cap 20 as defined by a pair of spaced parallel frangible strips 29 shown in broken lines in FIG. 2 of the drawings adjacent and extending beyond parallel portions of the elongated guide rib 22 from the perimeter edge of the multiple cap 20 to a secondary live hinge 30 formed by an area of reduced thickness therein.

A activation lip 31 is defined on the free end of the secondary cap 28 and extends outwardly beyond the perimeter edge of the multiple cap 20 providing a grip for the secondary cap 28 to be pivoted upwardly by tearing the frangible strips 29 to an open position, best seen in FIG. 5 of the drawings.

It will be evident that the elongated guide ribs 22 is registerably positioned within the recessed area 15 so that when the secondary cap 28 is closed the multiple cap 20 has a generally flat upper surface.

Referring to FIGS. 1, 2, 3 and 4 of the drawings a pair of retainer pins 32 and 33 extend from the surface of the multiple cap 20 on either side of said elongated guide ribs 22 each of the tabs 32 and 33 have a tubular body with an annular rib 34 formed on the exterior of the tubular body adjacent its free end.

In operation, the retainer pins 32 and 33 are aligned for registration within respective openings 35 and 36 within the top portion 10 on either side of the recessed area 15. Each tubular body is of a length sufficient to engage and extend through said openings 35 and 36 to a depth allowing the annular ribs 34 engagement under the top portion 10 as seen in FIG. 5 of the drawings. Once the retainer pins 32 and 33 are secured in the top portion 10 the multiple cap 20 cannot be removed from the top portion. Only the secondary cap 28 can be opened by tearing of the frangible strips 29 and pulled upwardly via the lip 31 to an open position shown in FIG. 5 of the drawings with the tubular plug 24 removed from the dispenser opening 26 allowing the contents of the container to pass therethrough.

It will thus be seen that a new and novel tamper evident closure has been illustrated and described and it will be apparent to those skilled in the art that various changes and modifications may be made therein without departing from the spirit of the invention, therefore I claim:

1. A tamper evident closure comprising a top portion having an annularly depending flange and means thereon for attachment to a container, said top portion having an dispensing opening therethrough, lock means on said annular depending flange securing same to said container, a multiple cap for registering with said top portion, a secondary cap movable into and away from a closed portion overlying said top portion, a tubular plug carried by said secondary cap in a position to cooperate with said dispensing opening and affect a seal therewith when said cap is in closed position, an intrical, thin flexible hinge extending from said top portion to said multiple cap, means of said multiple cap for releasing said secondary cap therefrom and hinge means formed on said multiple cap to said secondary cap, a recessed area on said top portion and a corresponding registerable elongated guide rib on said secondary cap for engagement therewith, means on said secondary cap for securing same to said top portion.

2. A tamper evident closure set forth in claim 1 wherein said top portion comprises a disc of a known diameter and said multiple cap portion comprises a disc having an annular bead of a dimension registerable within a groove in the perimeter edge of said top portion.

3. The tamper evident closure set forth in claim 1 wherein said means for attachment on said annular depending flange comprises a continuous thread pattern.

4. The tamper evident closure set forth in claim 1 wherein said locking means on said annular depending flange securing same to said container comprises a plurality of rachet recessed teeth.

5. The tamper evident closure set forth in claim 1 wherein said means on said multiple cap for releasing said secondary cap comprises spaced parallel frangible strips defining said secondary cap.

6. The tamper evident closure set forth in claim 1 wherein said means on said secondary cap for securing same to said top portion comprises a pair of depending tubular bodies having an annular rib on the free end thereof registerable within said top portion.

* * * * *